US006021761A

United States Patent [19]

Kellner et al.

[11] Patent Number: 6,021,761

[45] Date of Patent: Feb. 8, 2000

[54] HIGH-PRESSURE PUMP FOR FUEL DELIVERY IN FUEL INJECTION SYSTEMS OF INTERNAL COMBUSTION ENGINES

[75] Inventors: Andreas Kellner, Moeglingen; Juergen Hammer, Fellbach, both of Germany

[73] Assignee: Robert Bosch GmbH, Stuttgart, Germany

[21] Appl. No.: 09/232,657

[22] Filed: Jan. 19, 1999

[30] Foreign Application Priority Data

Jan. 16, 1998 [DE] Germany ..... 198 01 355

[51] Int. Cl.[7] ..... F02M 37/04

[52] U.S. Cl. ..... 123/495; 123/514; 417/368

[58] Field of Search ..... 123/495, 510, 123/514; 417/366, 368

[56] References Cited

U.S. PATENT DOCUMENTS

| | | | |
|---|---|---|---|
| 3,781,138 | 12/1973 | Bellmer | 417/368 |
| 3,873,243 | 3/1975 | Nusser | 417/368 |
| 4,392,463 | 7/1983 | Yasuhara . | |
| 5,058,557 | 10/1991 | Frank | 417/368 |
| 5,139,395 | 8/1992 | Kemmner | 417/366 |
| 5,146,895 | 9/1992 | Fehlmann | 123/495 |
| 5,593,287 | 1/1997 | Sadakata | 417/766 |
| 5,624,243 | 4/1997 | Omadaka | 417/366 |
| 5,701,872 | 12/1997 | Kaku | 123/495 |

FOREIGN PATENT DOCUMENTS

| | | |
|---|---|---|
| 665078 | 1/1952 | United Kingdom . |
| 2077862 | 12/1981 | United Kingdom . |

*Primary Examiner*—Carl S. Miller

*Attorney, Agent, or Firm*—Edwin E. Greigg; Ronald E. Greigg

[57] ABSTRACT

The invention relates to a high-pressure pump for fuel delivery in fuel injection systems of internal combustion engines, which includes a tank, a pre-feed pump, and the high-pressure pump. The pre-feed pump aspirates a total fuel flow from the tank and this total fuel flow is divided into a lubricating flow, which is conveyed through the high-pressure pump for the purpose of lubrication, and a delivery flow, which is acted on with high pressure by the high-pressure pump and is delivered to a common distributor rail. The fuel injection system prevents damage that could occur during operation. Damage is prevented because the total fuel flow is conveyed through the high-pressure pump for the purpose of lubrication, wherein a metering unit for the total fuel flow is provided in the high-pressure pump or in a return and assures that only a predetermined delivery flow is acted on with high pressure in the high-pressure pump. The fuel injection system according to the invention has the advantage that fewer separate parts are required. This reduces costs.

20 Claims, 1 Drawing Sheet

HIGH-PRESSURE PUMP FOR FUEL DELIVERY IN FUEL INJECTION SYSTEMS OF INTERNAL COMBUSTION ENGINES

BACKGROUND OF THE INVENTION

The invention relates to a high-pressure pump for fuel delivery in fuel injection systems of internal combustion engines, particularly in a common rail injection system which includes a tank, a pre-feed pump, and the high-pressure pump. The pre-feed pump aspirates a total fuel flow from the tank and this total fuel flow is divided into a lubricating flow, which is conveyed through the high-pressure pump for the purpose of lubrication, and a delivery flow, which is acted on with high pressure by the high-pressure pump and delivered to a common distributor rail.

Up till now, the proposal has been made to execute the division into a lubricating flow and a delivery flow upstream of the inlet of the high-pressure pump downstream of the pre-feed pump. The lubricating flow is then conveyed separately through the pump housing of the high-pressure pump. The delivery flow can be metered as needed and supplied to the high-pressure pump. The metering of the injection quantity can be carried out by a speed-regulated, electrical pre-feed pump. Another proposal provides for a mechanical pre-feed pump whose motor speed-dependent delivery flow is divided by means of an overflow valve into a lubricating flow and a delivery flow to the high-pressure elements of the high-pressure pump. The metering of the elements of the high-pressure pump then takes place by means of a magnet-controlled valve. The fuel quantity supplied to the individual elements of the high-pressure pump can therefore be varied. However, in the system that has been proposed up till now, damages have occurred, whose causes can be traced to an insufficient lubricating flow, in particular when starting using a mechanical pre-feed pump. It has furthermore turned out to be disadvantageous that the embodiments proposed previously require a large number of separate parts, which drives up manufacturing costs.

OBJECT AND SUMMARY OF THE INVENTION

The object of the invention, therefore, is to produce a high-pressure pump which overcomes the disadvantages mentioned above. In particular, damages that occur in the operation after the starting process should be prevented. Furthermore, a high-pressure pump should be produced which fulfills high demands for reliability and can nevertheless be manufactured in a reasonably priced manner.

This object is attained by the high-pressure pump disclosed herein after. Particular embodiments of the invention are disclosed herein.

The object is attained with a high-pressure pump for fuel delivery in fuel injection systems of internal combustion engines, particularly in a common rail injection system, which includes a tank, a pre-feed pump, and the high-pressure pump. The pre-feed pump aspirates a total fuel flow from the tank and this total fuel flow is divided into a lubricating flow, which is conveyed through the high-pressure pump for the purpose of lubrication, and a delivery flow, which is acted on with high pressure by the high-pressure pump and delivered to a common distributor rail. This object is attained in such a way that the total fuel flow is conveyed through the high-pressure pump for the purpose of lubrication, wherein a metering unit for the total fuel flow is integrated into the high-pressure pump. This metering assures that only a predetermined delivery flow is acted on with high pressure in the high-pressure pump. The high-pressure pump according to the invention has the advantage that in comparison with conventional high-pressure pumps, fewer separate parts are required. This reduces costs. In addition, the reliability is increased because the total fuel flow can be used for the lubrication and in particular for the cooling of the high-pressure pump. Through the integration of the metering unit into the high-pressure pump, the fuel supply lines that are acted on with negative pressure when aspirating are shortened, which results in a reduction of cavitation effects. This prevents damage. Moreover, the maximal available liquid flow from the pre-feed pump is always available for the cooling and lubrication of the high-pressure pump drive.

A particular embodiment of the invention is characterized in that the metering unit includes a flow regulating valve. This embodiment produces a simple regulating concept, which needs only one quantity adjuster for the entire high-pressure pump, which in turn can contain a number of elements such as pistons. As a result, the development risk, the testing expenditure, and the costs can be kept low.

Another particular embodiment of the invention is characterized in that the flow regulating valve can be electromagnetically controlled. The electromagnetic control permits the use of a conventional, unregulated pre-feed pump with the high-pressure pump according to the invention. The metering can be carried out, for example, by means of an integrated pressure regulator. The electromagnetically controlled flow control valve can regulate the fuel flow to be acted on with high pressure as needed. As a result, the efficiency of the engine to be supplied with fuel is increased. In addition, an unnecessary heating of the fuel is prevented because no excess fuel is acted on with high pressure. If a regulated pre-feed pump is used, a flow regulating valve can be used to divide the lubricating flow and the delivery flow without electromagnetic control.

Another particular embodiment of the invention is characterized in that an inlet valve is disposed in the feed direction downstream of the flow regulating valve and acts as a check valve during the compression stroke. On the one hand, the inlet valve assures that a high pressure can be built up in the elements of the high-pressure pump and on the other hand, assures that the fuel only travels into the elements of the high-pressure pump when a particular pressure difference is achieved between the intake of the inlet valve and the pressure in the high-pressure element itself. The use of check valves in high-pressure pumps is known. This provides the advantage that the current invention can be produced using known means. Costs are therefore reduced. In the event of damage, e.g. a leakage in the low-pressure delivery circuit, the flow routing according to the invention and the disposition of the flow regulating valve according to the invention assures that the entire quantity additionally delivered is first used to cool and lubricate the high-pressure pump drive. If the pressure is no longer sufficient for a continuous metering, this leads to the fact that impermissible regulatory deviation is detected in the rail pressure and the motor is switched off. During the coasting phase until the machine comes to a stop, the high-pressure pump likewise continues to turn and continues to be supplied with the maximally available lubricant quantity by means of the flow routing. This safety function is made possible without additional valves.

Another particular embodiment of the invention is characterized in that the pump has a return that is equipped with a check valve. The return can, for example, be connected to the tank. Consequently, it is assured that excess fuel is not unnecessarily acted on with high pressure, but can flow directly back into the tank.

Another particular embodiment of the invention is characterized in that the pre-feed pump is integrated into the high-pressure pump. This reduces the number of separate parts. The line paths are also shortened. When the fuel is metered by means of the electromagnetically controllable flow regulating valve, a conventional mechanical pre-feed pump can be integrated into the high-pressure pump.

Another particular embodiment of the invention is characterized in that the high-pressure pump includes a drive shaft that is embodied eccentrically or has cam-like raised areas in the circumference direction, wherein preferably a number of pistons disposed radially with regard to the drive shaft can be set into a reciprocating motion in respective cylinder chambers through the rotation of the drive shaft. The metering unit assures that only a predetermined delivery flow travels into the respective cylinder chambers and is acted on with high pressure by the associated cylinders.

The present invention generally has the advantage that it can be produced simply and inexpensively. The fundamental concept of the present invention can furthermore be simply used in conventional high-pressure pumps.

The invention will be better understood and further objects and advantages thereof will become more apparent from the ensuing detailed description of preferred embodiments taken in conjunction with the drawings. The features mentioned in the claims and in the description can be essential to the invention individually in and of themselves or in arbitrary combinations. One way of embodying the invention claimed will be explained in detail below in conjunction with the sole Figure.

BRIEF DESCRIPTION OF THE DRAWING

The sole FIGURE is a schematic representation of a fuel injection system according to the invention.

DESCRIPTION OF THE PREFERRED EMBODIMENTS

Figure 1:
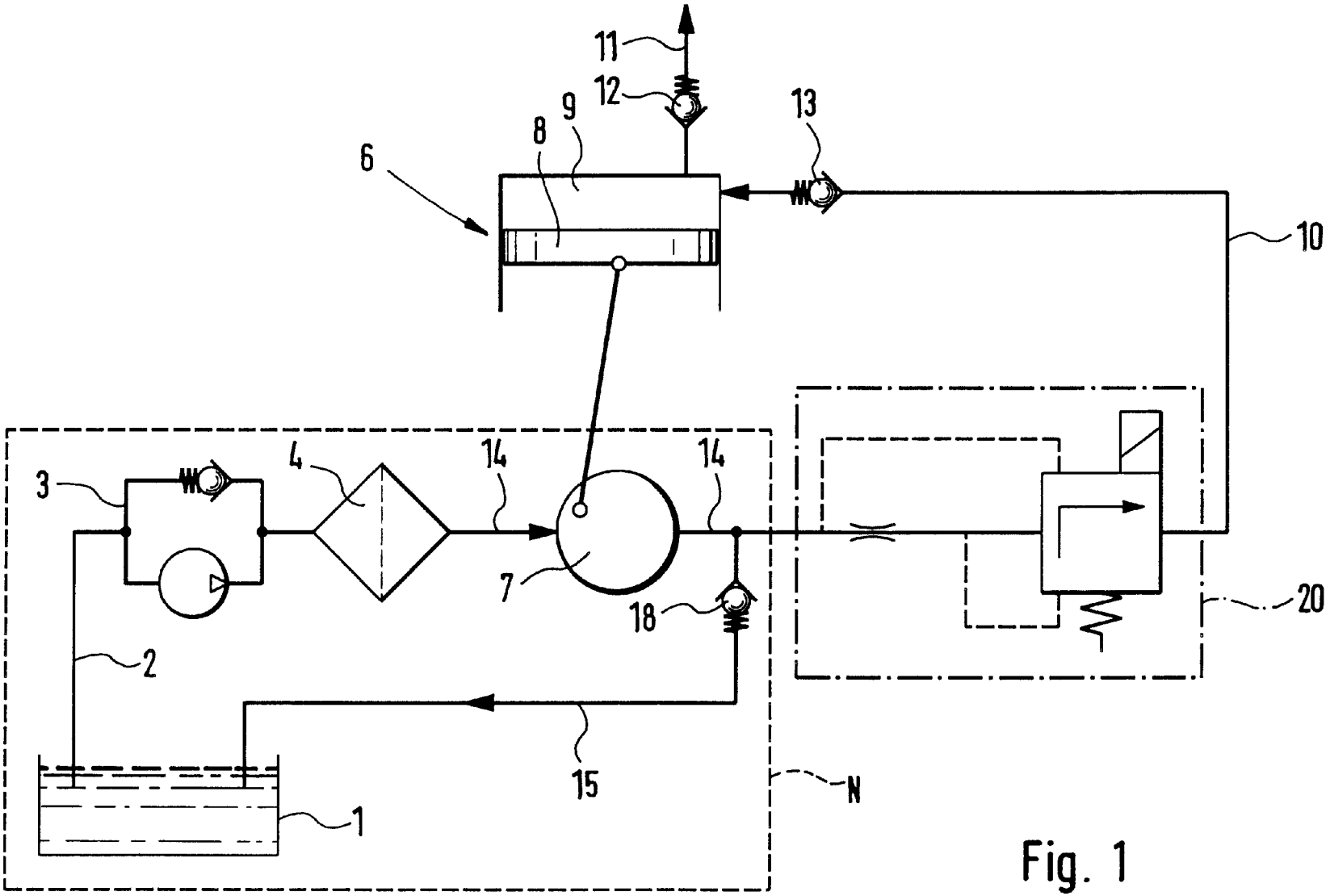

In particular, the fuel injection system depicted concerns a common rail injection system for fuel delivery to diesel engines. In this connection "common rail" means the same thing as "common line". In contrast to conventional high-pressure injection systems in which the fuel is delivered by way of separate lines to the individual combustion chambers, the injection nozzles in common rail injection systems are supplied from a common line which is also referred to as a common distributor rail.

According to the current body of knowledge, future high-pressure pumps for common rail diesel injection systems will require a metering unit which can regulate the delivery quantity of the high-pressure pump as needed. The metering unit is used as an adjusting member in the regulation circuit of the rail pressure.

The fuel injection system depicted in the sole Fig. includes a low-pressure circuit N, which is surrounded by a dashed rectangle. Diesel fuel is contained in a tank 1. The tank 1 is connected to a delivery pump 3 by way of a fuel line 2. The pre-feed pump 3 aspirates fuel from the tank 1 and thereby supplies a high-pressure pump 6. A fuel filter 4 is disposed between the pre-feed pump 3 and the high-pressure pump 6.

The symbolically depicted high-pressure pump 6 includes a drive shaft 7, which drives a piston 8. The piston 8 can be set into a reciprocating motion in a cylinder chamber 9. The reciprocating motion of the piston 8 aspirates a delivery flow 10 into the cylinder chamber 9. In the so-called intake stroke, the piston 8 moves toward the drive shaft 7. In the subsequent delivery stroke, the piston 8 moves away from the drive shaft 7. The fuel contained in the cylinder chamber 9 is compressed in the delivery stroke and supplied by way of a line 11 in which a check valve 12 is disposed, to a common distributor rail that is not shown.

The high-pressure pump can, for example, be a radial piston pump that is equipped with a drive shaft supported in a pump housing. The drive shaft can be embodied eccentrically or can have cam-like raised areas in the circumference direction. The radial piston pump is preferably equipped with a number of pistons, each in a respective cylinder chamber, disposed radially with regard to the drive shaft and these pistons can be driven into a reciprocating motion in the respective cylinder chambers through the rotation of the drive shaft.

As is indicated in the schematic representation in the sole Fig., the total fuel flow 14, which is supplied by the pre-feed pump and acted on with low pressure, is conveyed through the crank case of the high-pressure pump 8 in order to lubricate the moving parts of the high-pressure pump. Furthermore, the total fuel flow 14 is used for cooling.

The total fuel flow 14 is then divided into a delivery flow 10 and a return flow 15, as shown in the sole Fig. A check valve 18 is disposed in the return line, which is labeled 15. The check valve 18 assures that excess fuel, which is supplied, for example, by an unregulated pre-feed pump 3, can flow back into the tank 1 as soon as a particular minimum pressure is exceeded.

The delivery flow 10 that is supplied to the cylinder chamber 9 is regulated by a metering unit 20. The metering unit 20 includes a magnet-controlled flow regulating valve with an integrated pressure regulator. The magnet-controlled flow regulating valve has the task of metering the as needed delivery flow in accordance with the power supply of the proportional magnet and of the internal flow regulator (pressure regulator). The metering unit 20 is advantageously integrated into the pump housing or into the return of the high-pressure pump 6. An inlet valve 13 is disposed between the metering unit 20 and the cylinder space 9 and functions as a check valve during the compression stroke. The inlet valve 13 assures that the delivery flow 10 only travels into the cylinder chamber 9 when a particular pressure difference is exceeded. Furthermore, its function as a check valve permits the pressure increase in the high-pressure pump elements.

The principle of the present invention is also useful when a regulated pre-feed pump is used as a metering unit. A pre-feed pump of this kind supplies the required delivery flow on an as needed basis and also supplies a constant lubricating and cooling flow. The subsequent division of the total flow into the delivery flow and the return flow is carried out by way of a flow regulating valve, which is embodied in precisely the same way as the flow regulating valve described above, but has no magnetic control. The through flow by way of the pressure regulator does in fact make the constant lubricating flow possible, whereas the remaining flow travels to the elements of the high-pressure pump and is compressed at a high pressure there.

The pre-feed pump 3 is advantageously integrated into the high-pressure pump 6. As a result, the volumes that are acted on with low pressure during the intake stroke are small, which leads to a reduced occurrence of cavitation. Damages in the operation of the high-pressure pump are consequently prevented.

The foregoing relates to preferred exemplary embodiments of the invention, it being understood that other variants and embodiments thereof are possible within the spirit and scope of the invention, the latter being defined by the appended claims.

We claim:

1. A high-pressure pump for fuel delivery in a common rail injection system of internal combustion engines, which comprises a fuel tank (1), a pre-feed pump (3), and the high-pressure pump (6), wherein the pre-feed pump (3) aspirates a total fuel flow (2) from the tank (1) and this total fuel flow is divided into a lubricating flow, which is conveyed through the high-pressure pump for the purpose of lubrication, and a delivery flow, which is acted on with high pressure by the high-pressure pump and delivered to a common distributor rail, the total fuel flow (2, 14) is conveyed through the high-pressure pump (6) for the purpose of lubrication, a metering unit (20) is integrated into the high-pressure pump (6) for the total fuel flow (14) and assures that only a predetermined delivery flow (10) is acted on with high pressure in the high-pressure pump (6).

2. The high-pressure pump according to claim 1, in which the metering unit (20) includes a flow regulating valve.

3. The high-pressure pump according to claim 2, in which the flow regulating valve (20) is electromagnetically controlled.

4. The high-pressure pump according to claim 2, in which an inlet valve (13) is disposed downstream of the flow regulating valve (20) in the feed direction.

5. The high-pressure pump according to claim 1, in which the pump has a return (15) which is equipped with a check valve (18).

6. The high-pressure pump according to claim 1, in which the pre-feed pump (3) is integrated into the high-pressure pump (6).

7. The high-pressure pump according to claim 1, in which the high-pressure pump (6) includes a drive shaft (7) that is embodied with up-lifting raised areas which up-lifting raised areas are in the circumference direction, wherein a number of pistons (8), which are disposed radially with regard to the drive shaft (7), are driven into a reciprocating motion, each in a respective cylinder chamber (8), through the rotation of the drive shaft (7).

8. The high-pressure pump according to claim 3, in which an inlet valve (13) is disposed downstream of the flow regulating valve (20) in the feed direction.

9. The high-pressure pump according to claim 2, in which the pump has a return (15) which is equipped with a check valve (18).

10. The high-pressure pump according to claim 3, in which the pump has a return (15) which is equipped with a check valve (18).

11. The high-pressure pump according to claim 4, in which the pump has a return (15) which is equipped with a check valve (18).

12. The high-pressure pump according to claim 2, in which the pre-feed pump (3) is integrated into the high-pressure pump (6).

13. The high-pressure pump according to claim 3, in which the pre-feed pump (3) is integrated into the high-pressure pump (6).

14. The high-pressure pump according to claim 4, in which the pre-feed pump (3) is integrated into the high-pressure pump (6).

15. The high-pressure pump according to claim 5, in which the pre-feed pump (3) is integrated into the high-pressure pump (6).

16. The high-pressure pump according to claim 2, in which the high-pressure pump (6) includes a drive shaft (7) that is embodied with up-lifting raised areas which up-lifting raised areas are in the circumference direction, wherein a number of pistons (8), which are disposed radially with regard to the drive shaft (7), are driven into a reciprocating motion, each in a respective cylinder chamber (8), through the rotation of the drive shaft (7).

17. The high-pressure pump according to claim 3, in which the high-pressure pump (6) includes a drive shaft (7) that is embodied with up-lifting raised areas which up-lifting raised areas are in the circumference direction, wherein a number of pistons (8), which are disposed radially with regard to the drive shaft (7), are driven into a reciprocating motion, each in a respective cylinder chamber (8), through the rotation of the drive shaft (7).

18. The high-pressure pump according to claim 4, in which the high-pressure pump (6) includes a drive shaft (7) that is embodied with up-lifting raised areas which up-lifting raised areas are in the circumference direction, wherein a number of pistons (8), which are disposed radially with regard to the drive shaft (7), are driven into a reciprocating motion, each in a respective cylinder chamber (8), through the rotation of the drive shaft (7).

19. The high-pressure pump according to claim 5, in which the high-pressure pump (6) includes a drive shaft (7) that is embodied with up-lifting raised areas which up-lifting raised areas are in the circumference direction, wherein a number of pistons (8), which are disposed radially with regard to the drive shaft (7), are driven into a reciprocating motion, each in a respective cylinder chamber (8), through the rotation of the drive shaft (7).

20. The high-pressure pump according to claim 6, in which the high-pressure pump (6) includes a drive shaft (7) that is embodied with up-lifting raised areas which up-lifting raised areas are in the circumference direction, wherein a number of pistons (8), which are disposed radially with regard to the drive shaft (7), are driven into a reciprocating motion, each in a respective cylinder chamber (8), through the rotation of the drive shaft (7).

* * * * *